US005481158A

United States Patent [19]

Kato et al.

[11] Patent Number: 5,481,158

[45] Date of Patent: Jan. 2, 1996

[54] ELECTRON MULTIPLIER WITH IMPROVED DYNODE GEOMETRY FOR REDUCED CROSSTALK

[75] Inventors: Hisaki Kato; Suenori Kimura; Kiyoshi Nakatsugawa; Tsuguo Uchino; Itsuo Ozawa; Hiroyuki Onda, all of Hamamatsu, Japan

[73] Assignee: Hamamatsu Photonics K.K., Hamamatsu, Japan

[21] Appl. No.: 148,280

[22] Filed: Nov. 8, 1993

[30] Foreign Application Priority Data

Nov. 9, 1992 [JP] Japan ..... 4-298608

[51] Int. Cl.[6] ..... H01J 43/10

[52] U.S. Cl. ..... 313/533; 313/535; 313/536

[58] Field of Search ..... 313/532, 533, 313/535, 536, 537, 103 R

[56] References Cited

U.S. PATENT DOCUMENTS

| | | | |
|---|---|---|---|
| 2,433,700 | 12/1947 | Larson | 313/103 R |
| 4,649,314 | 3/1987 | Eschard | 313/103 CM |
| 4,825,118 | 4/1989 | Kyushima | 313/104 |
| 4,881,008 | 11/1989 | Kyushima et al. | 313/533 |
| 4,998,037 | 3/1991 | Kerkhof et al. | 313/103 CM |
| 5,077,504 | 12/1991 | Helvy | 313/103 R |
| 5,126,629 | 6/1992 | Chopy | 313/533 |
| 5,196,690 | 3/1993 | Flesner et al. | 313/534 |

FOREIGN PATENT DOCUMENTS

| | | | |
|---|---|---|---|
| 0427545 | 5/1991 | European Pat. Off. | H01J 43/04 |
| 5539171 | 3/1980 | Japan | H01J 43/18 |
| 20800167 | 1/1982 | United Kingdom | H01J 43/22 |

OTHER PUBLICATIONS

RCA Photomultiplier Handbook, 1980, pp. 17, 18 and 26–35.

Patent Abstracts of Japan, vol. 9, No. 19 (E–292)(1742) 25 Jan. 1985 & JP–A–59 167 946 (Hamamatsu) 21 Sep. 1984 *abstract*.

*Primary Examiner*—Donald J. Yusko
*Assistant Examiner*—Michael Day
*Attorney, Agent, or Firm*—Cushman Darby & Cushman

[57] ABSTRACT

The present invention relates to a linear multi-anode photomultiplier or electron multiplier on which a plurality of light beams to be measured or energy beams of electrons, ions and so forth are incident one-dimensionally. The object of the present invention is to prevent crosstalk between dynode arrays caused by leaking electrons. A transmission type photomultiplier is characterized in that the direction of secondary electron emission of the first-stage dynode of each dynode array is set in the opposite direction at 180° from that of an adjacent dynode array. Then, adjacent dynode arrays will not oppose each other but are shifted from each other at a predetermined distance in the lateral direction. Accordingly, even if electrons leak from a gap between dynodes of a certain dynode array, the leaking electrons will not enter the adjacent dynode array, thereby preventing crosstalk.

24 Claims, 10 Drawing Sheets

ELECTRON MULTIPLIER WITH IMPROVED DYNODE GEOMETRY FOR REDUCED CROSSTALK

BACKGROUND OF THE INVENTION

1. Field of the Invention

The present invention relates to a photomultiplier or an electron multiplier having dynode arrays for multiplying electrons by the secondary electron emission effect and, more particularly, to a so-called linear multi-anode photomultiplier and electron multiplier in which portions thereof, on which a plurality of light beams to be measured or energy beams of electrons, ions and so forth are incident, are aligned one-dimensionally.

2. Related Background Art

FIGS. 1, 2 and 3 show an example of a conventional linear multi-anode photomultiplier. This photomultiplier is a head-on type photomultiplier in which incident window 2 for receiving light beams to be measured are formed on one end face of a glass bulb 1. Transmission type photoelectric surfaces 3 for converting the incident light to be measured to photoelectrons are formed on the inner surface of the incident window 2 in a one-dimensional array. One focusing electrode 4 is arranged inside the glass bulb 1 to be parallel to the incident window 2, and openings 5 are formed in a one-dimensional array at a portion of the focusing electrode 4 opposing the photoelectric surfaces 3. When a plurality of light beams to be measured are incident on the respective photoelectric surfaces 3 to generate photoelectrons, the photoelectrons are guided to corresponding dynode arrays 6 through the openings 5. The dynode arrays 6 of the photomultiplier shown in FIG. 1 have in-line dynode structure. The photoelectrons are multiplied by the secondary electron emission effect in each stage of dynode 7 of the respective dynode arrays 6, and the multiplied photoelectrons are finally captured by anodes 8 as output signals.

In the conventional photomultiplier described above, some of leaking electrons from the gaps among the dynodes 7 of each dynode array 6 enter the gaps among the dynodes 7 of an adjacent dynode array 6 to cause so-called crosstalk. Crosstalk impairs independency of each dynode array 6 and degrades the detection precision of the light beams to be measured.

The photomultiplier described above is a transmission type photomultiplier having photoelectric surfaces on the inner surface of the incident window. A reflection type photomultiplier has a similar problem of crosstalk.

An electron multiplier for detecting the energy beams of electrons, ions and so force also has a problem of crosstalk since its dynode array has a substantially same arrangement.

SUMMARY OF THE INVENTION

It is, therefore, an object of the present invention to provide a linear multi-anode type photomultiplier and electron multiplier that can prevent crosstalk between dynode arrays caused by leaking electrons.

The above object and other objects will be further apparent from the following description.

Provided according to the present invention is a photomultiplier comprising a transparent sealed container having, on one end face thereof, an incident window on which light to be measured is incident, first and second transmission type photoelectric surfaces formed on an inner surface of said incident window, and first and second dynode arrays having a plurality of stages of dynodes for multiplying photoelectrons supplied from said first and second transmission type photoelectric surfaces, respectively. Photoelectron incident ports of first-stage dynodes of said first and second dynode arrays oppose said first and second transmission type photoelectric surfaces, respectively. The dynodes of said first and second dynode arrays are arranged such that electrons leaking from said first dynode array will not enter said second dynode array.

Also provided according to the present invention is a photomultiplier comprising a transparent sealed container having, on one end face thereof, an incident window on which light to be measured is incident, first and second reflection type photoelectric surfaces arranged in said sealed container and having light beam incident ports arranged to oppose said incident window, and first and second dynode arrays having a plurality of stages of dynodes for multiplying photoelectrons supplied from said first and second reflection type photoelectric surfaces, respectively. The first and second dynode arrays are provided to correspond to said first and second reflection type photoelectric surfaces. The dynodes of said first and second dynode arrays are arranged such that electrons leaking from said first dynode array will not enter said second dynode array.

Further provided according to the present invention is an electron multiplier comprising first and second dynode arrays having a plurality of stages of dynodes for multiplying electrons generated when energy beams of electrons, ions and so forth are incident thereon. The plurality of stages of dynodes include first-stage dynodes arranged such that energy beam incident ports thereof are directed in a direction along which said energybeams are incident. The dynodes of said first and second dynode arrays are arranged such that electrons leaking from said first dynode array will not enter said second dynode array.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Embodiment 1

Figure 1:
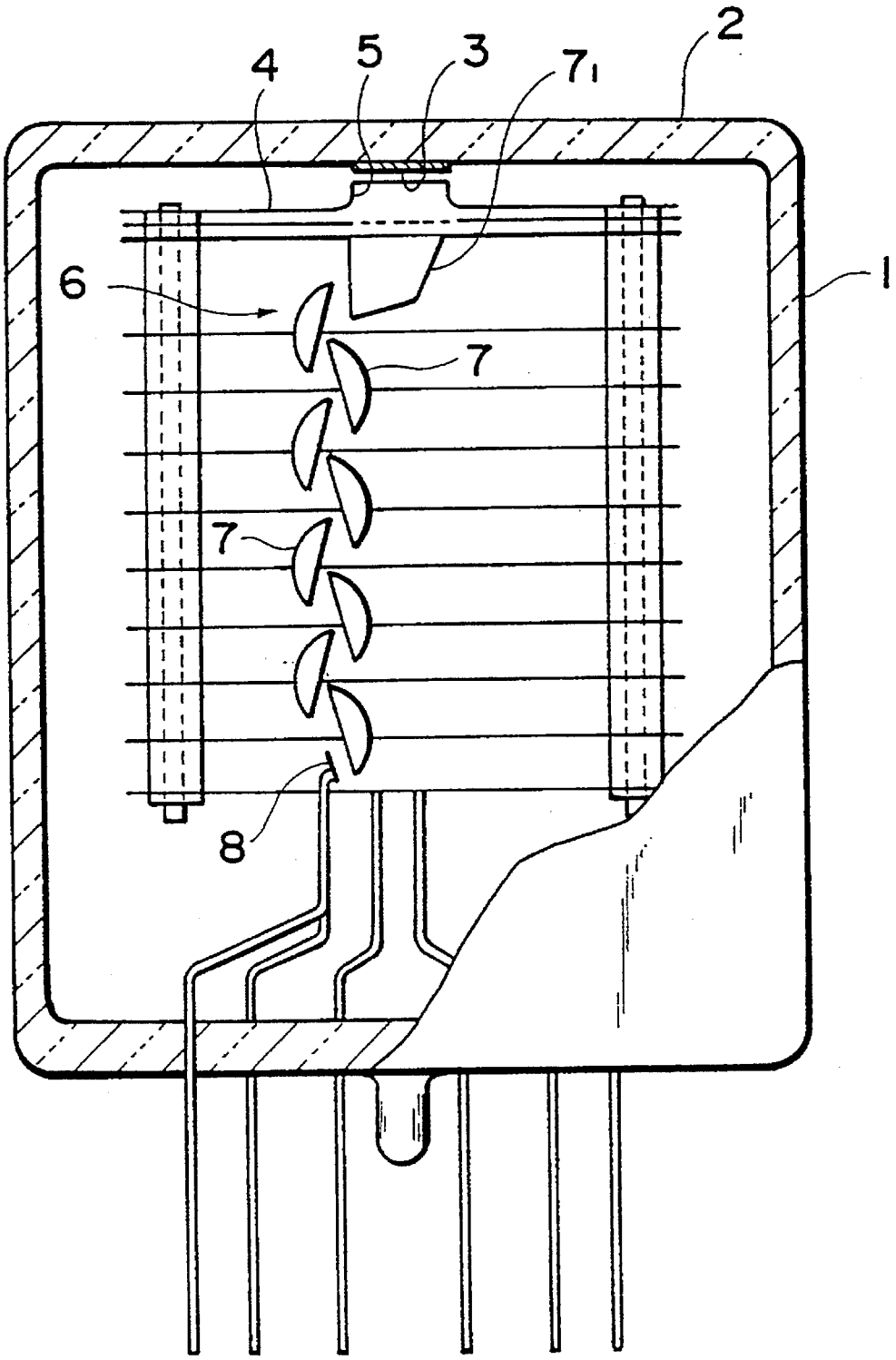
Fig. 1 PRIOR ART
FIG. 1 is a longitudinal sectional view showing a conventional transmission type linear multi-anode photomultiplier.

The preferred embodiments of the present invention will be described in detail with reference to the accompanying drawings. Note that the same or corresponding portions as in the conventional structures described above are denoted by the same reference numerals.

Figure 4:
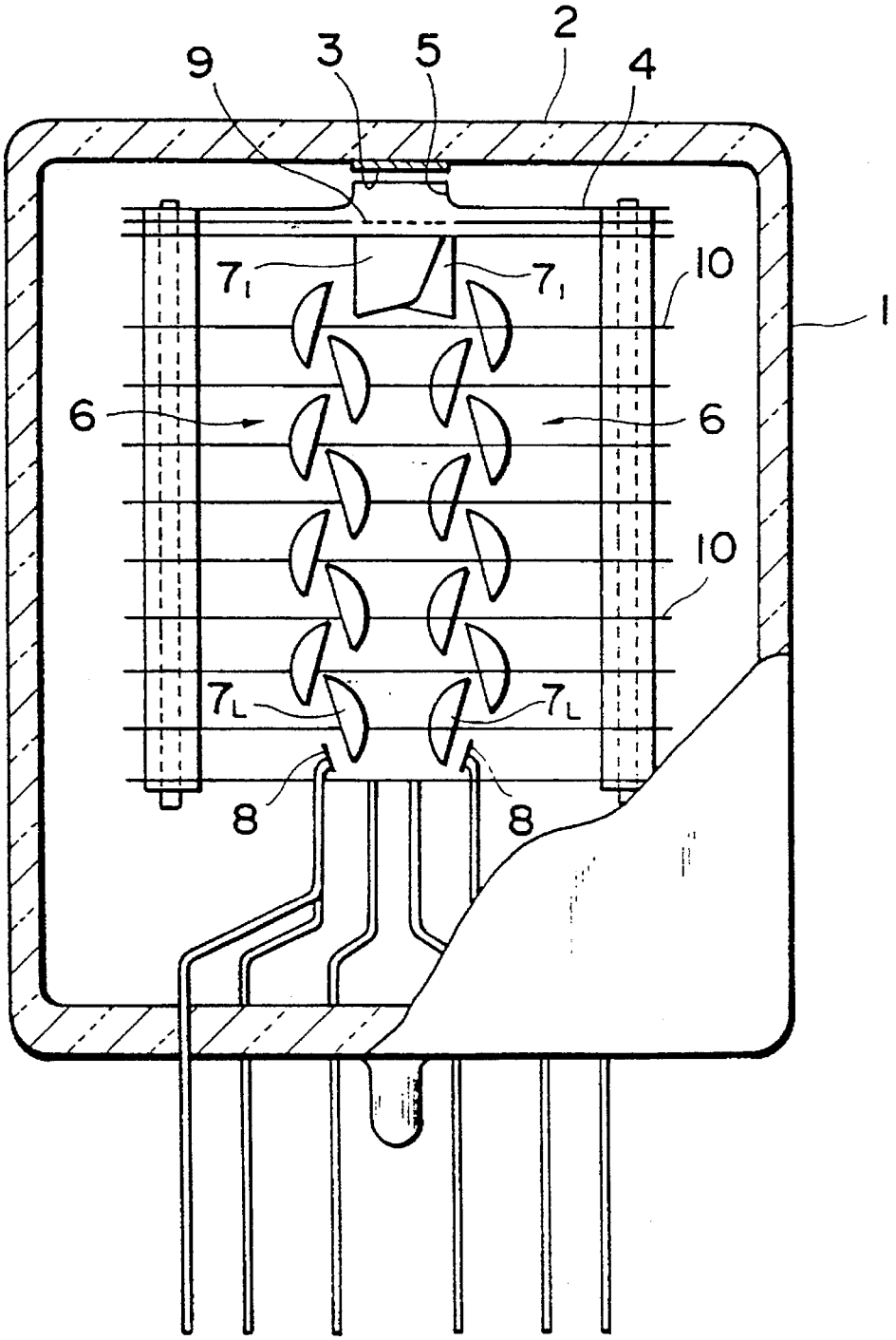
FIG. 4 is a longitudinal sectional view showing an embodiment of a transmission type linear multi-anode photomultiplier according to the present invention.
Figure 5:
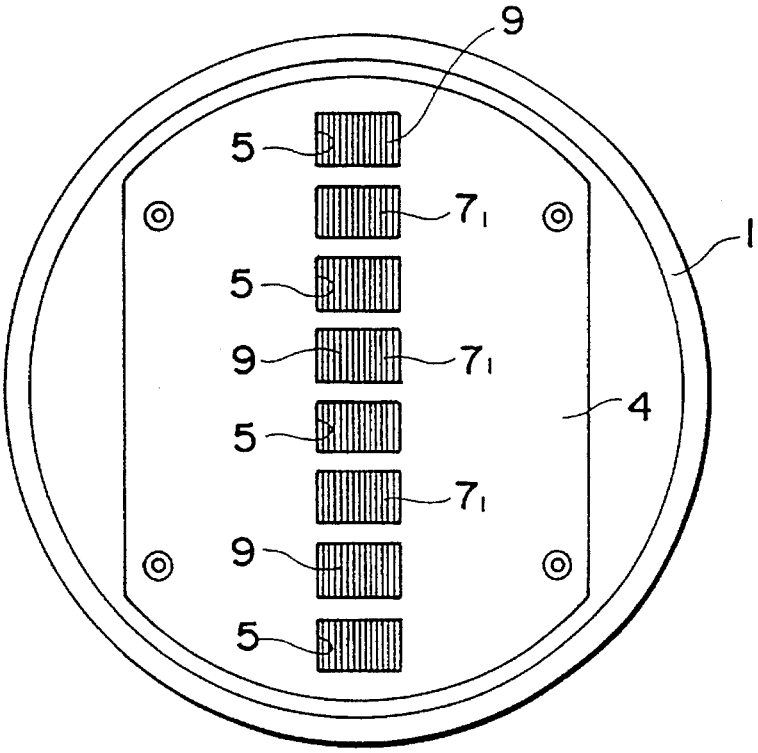
FIG. 5 is a plan view of the photomultiplier of FIG. 4.

FIGS. 4 and 5 show a transmission type linear multi-anode photomultiplier according to a preferred embodiment of the present invention. Referring to FIGS. 4 and 5, reference numeral 1 denotes a transparent sealed container, and more preferably, a glass bulb. Incident window 2 on which a plurality of light beams to be measured are incident are formed at one end face of the glass bulb 1. A plurality of transmission type photoelectric surfaces 3 are formed on the inner surface of the incident window 2 and aligned one-dimensionally, i.e., in one array. One set of a dynode array 6 for receiving photoelectrons from the corresponding photoelectric surface 3 and multiplying them by the secondary electron emission effect is provided inside the glass bulb 1 for each photoelectric surface 3. The photoelectron incident ports of first-stage dynodes $7_1$ of the respective dynode arrays 6 are arranged to oppose the photoelectric surface 3 and are thus aligned in a one-dimensional array. One focusing electrode 4 is arranged between the photoelectric surfaces 3 and the dynode arrays 6, and openings 5 serving as the inlet ports of the photoelectrons are formed at portions of the focusing electrode 4 adjacent to dynodes $7_1$. An anode 8 is arranged in front of a last-stage dynode $7_L$ of each dynode array 6 to collect secondary electrons emitted from this last-stage dynode $7_L$. In FIGS. 4 and 5, reference numerals 9 denote mesh electrodes. The mesh electrodes 9 reliably guide the photoelectrons incident through the openings 5 of the focusing electrode 4 to the corresponding first-stage dynodes $7_1$ without flowing photoelectrons in the opposite direction.

The dynode arrays 6 used in this embodiment have inline dynode structure and all of them have the same arrangement. The dynodes 7 of each dynode array 6 are arranged in the staggered manner along the direction of the incident light beam to be measured such that the recessed surfaces (secondary electron emission surfaces) of their arcuated wall portions oppose each other. The dynodes 7 located on the same stage are supported by one conductive support plate 10 and the same voltage is applied to the dynodes 7 on the same stage by a bleeder resistor (not shown).

Figure 6:
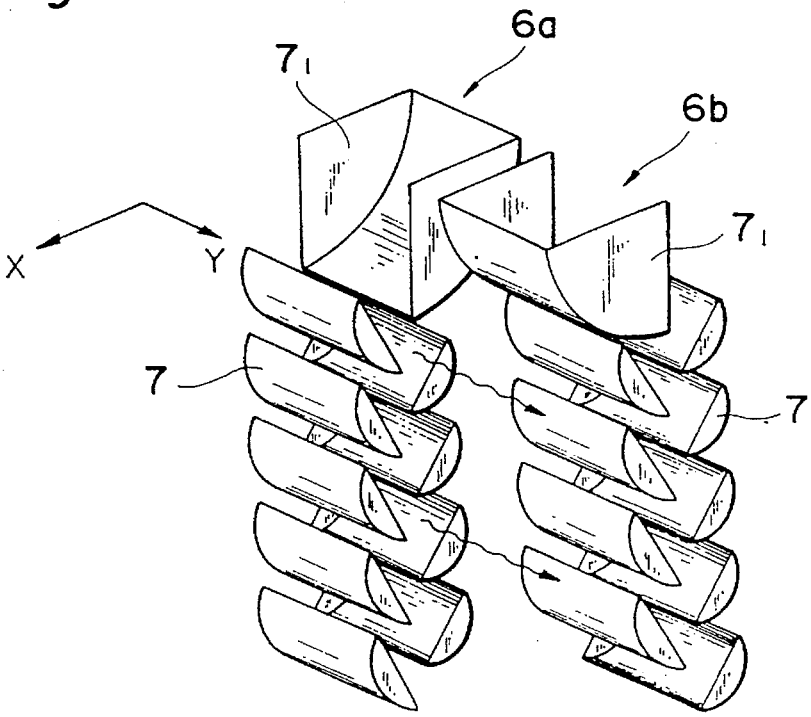
FIG. 6 is a perspective view showing the arrangement of dynode arrays used in the photomultiplier of FIG. 4.

According to the present invention, the adjacent dynode arrays 6 are directed alternately in the opposite directions. More specifically, as shown in FIG. 6, when the direction of secondary electron emission of the first-stage dynode $7_1$ of one dynode array 6*a* is set in the +X direction, the direction of secondary electron emission of the first-stage dynode $7_1$ of a dynode array 6*b* adjacent to the dynode array 6*a* is set in an opposite direction at 180° (−X direction). Then, the dynode array 6*a* is arranged at a predetermined distance from the adjacent dynode array 6*b* in the +X direction. This arrangement applies to other dynode arrays 6.

The operation of the photomultiplier having the above arrangement according to the present invention will be described.

When a plurality of light beams to be measured are incident on the incident window 2 of the glass bulb 1, the respective light beams to be measured are converted to photoelectrons by the corresponding photoelectric surfaces 3. The photoelectrons are incident on the first-stage dynodes $7_1$ of the corresponding dynode arrays 6 through the openings 5 of the focusing electrode 4, and bombarded on the secondary electron emission surfaces of the first-stage dynodes $7_1$, thereby emitting secondary electrons. The secondary electrons are further sequentially multiplied by the dynodes 7 from the second stages, finally collected by the anodes 8, and output to the outside of the photomultiplier as output signals.

The dynode array 6*a* in FIG. 6 will be considered. While the secondary electrons are transmitted in the dynode array 6*a*, some of them leak from the gap among the dynodes 7 in the lateral direction (+Y direction in FIG. 6). However, the dynode array 6*b* adjacent to this dynode array 6*a* is shifted from the dynode array 6*a* in the −X direction, and the gaps among the dynodes 7 of the dynode array 6*b* are remote from those of the dynode array 6a. Therefore, the leaking electrons from the dynode array 6*a* will not mix in the adjacent dynode array 6*b*, so that occurrence of crosstalk is prevented. Accordingly, the respective dynode arrays 6 have excellent separation and independency. The detection result of the light beam to be measured incident on each photoelectric surface 3 has high precision which is not adversely affected by other light beams to be measured.

Figure 2:
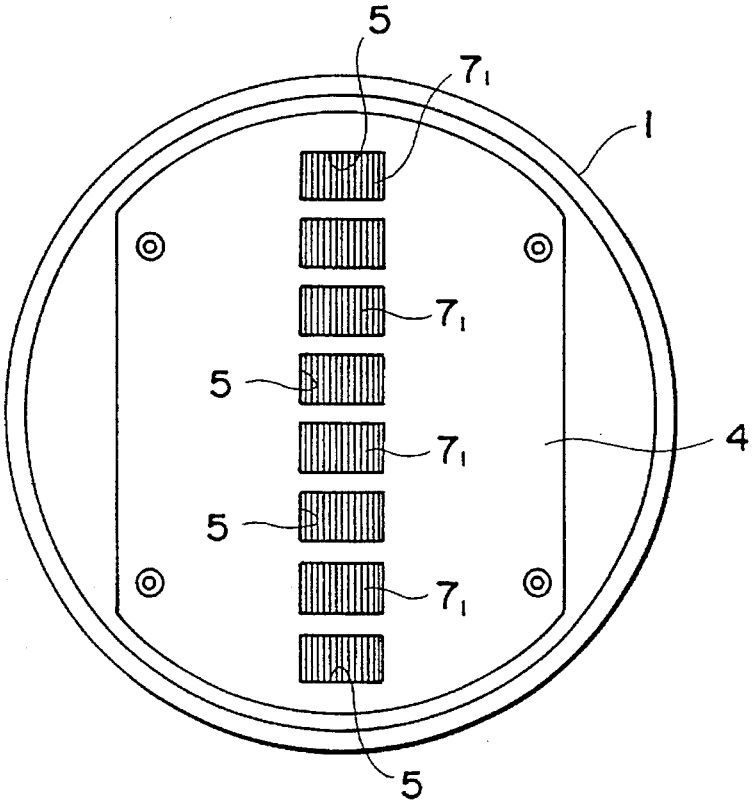
Fig. 2 PRIOR ART
FIG. 2 is a plan view of the photomultiplier of FIG. 1.
Figure 3:
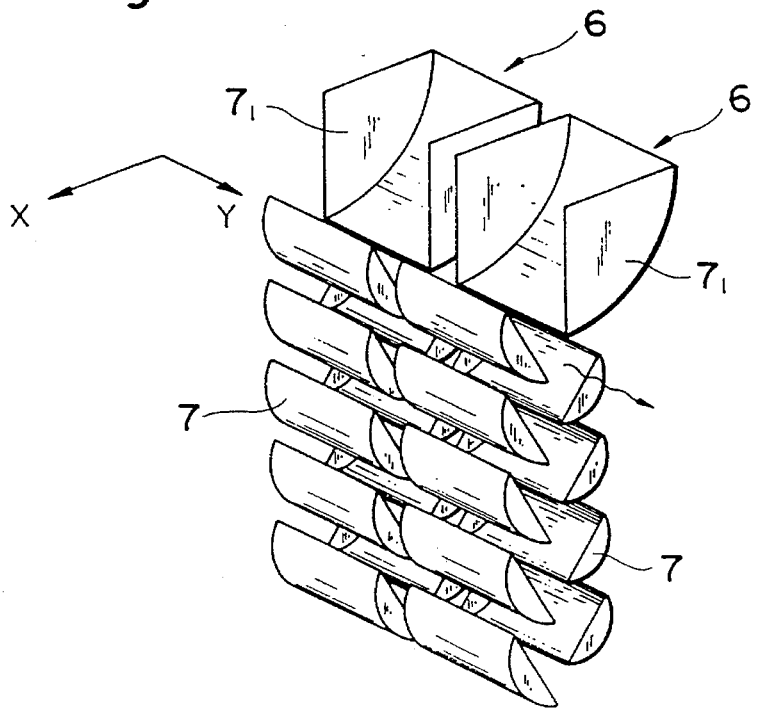
Fig. 3 PRIOR ART
FIG. 3 is a perspective view showing the arrangement of dynode arrays used in the photomultiplier of FIG. 1.

The following Table 1 indicates the rate of occurrence of crosstalk in the conventional 6-channel photomultiplier shown in FIGS. 1 and 2.

TABLE 1

| Output | Light Beam To Be Measured Incident Channel | | | | | |
|---|---|---|---|---|---|---|
| Channel | 1 CH | 2 CH | 3 CH | 4 CH | 5 CH | 6 CH |
| 1 CH | — | 0.21% | | | | |
| 2 CH | 0.24% | — | 0.22% | | | |
| 3 CH | | 0.24% | — | 0.22% | | |
| 4 CH | | | 0.27% | — | 0.20% | |
| 5 CH | | | | 0.24% | — | 0.39% |
| 6 CH | | | | | 0.17% | — |

Table 2 indicates the rate of occurrence of crosstalk in the 6-channel photomultiplier of the same type as that shown in FIGS. 4 and 5.

TABLE 2

| Output | Light Beam To Be Measured Incident Channel | | | | | |
|---|---|---|---|---|---|---|
| Channel | 1 CH | 2 CH | 3 CH | 4 CH | 5 CH | 6 CH |
| 1 CH | | 0.04% | | | | |
| 2 CH | 0.09% | | 0.03% | | | |
| 3 CH | | 0.10% | | 0.07% | | |
| 4 CH | | | 0.04% | | 0.03% | |
| 5 CH | | | | 0.05% | | 0.08% |

TABLE 2-continued

| Output | Light Beam To Be Measured Incident Channel | | | | | |
|---|---|---|---|---|---|---|
| Channel | 1 CH | 2 CH | 3 CH | 4 CH | 5 CH | 6 CH |
| 6 CH | | | | | 0.02% | |

From Tables 1 and 2, it is apparent that crosstalk is largely decreased by adopting the arrangement of the present invention.

Embodiment 2

Figure 7:
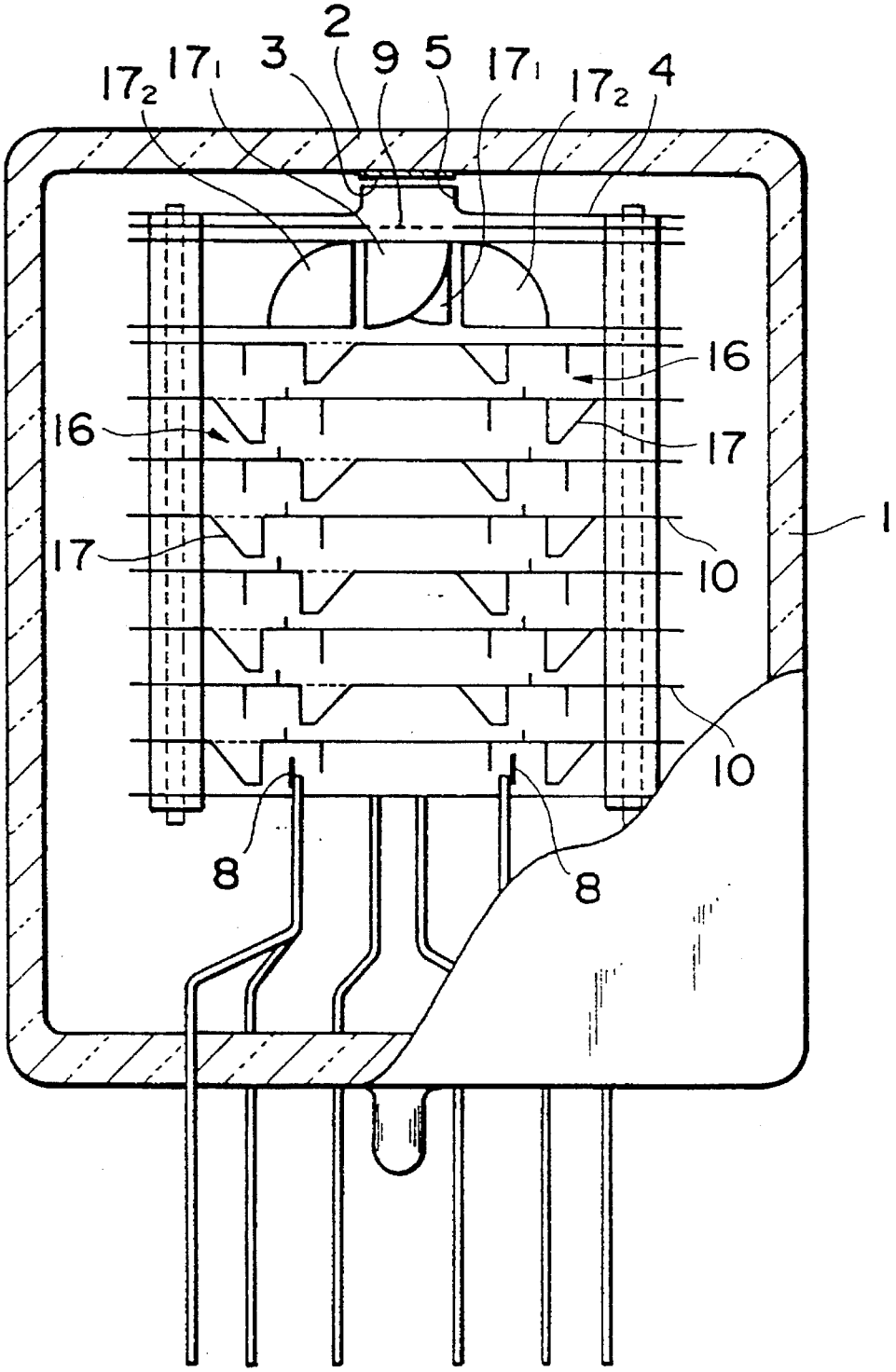
FIG. 7 is a longitudinal sectional view showing another embodiment of a transmission type linear multi-anode photomultiplier according to the present invention.

Although the dynode arrays 6 used in the photomultiplier of the above embodiment have in-line dynode structure, the present invention is not limited to them. For example, in dynode arrays 16 of a photomultiplier shown in FIG. 7, dynodes on the first and second stages use cylindrical quarter dynodes $\mathbf{17}_1$ and $\mathbf{17}_2$, and dynodes on the third stage and so on have venetian-blind structure. Except for that, the constituent elements are the same as in the above embodiment. Thus, they are denoted by the same reference numerals, and a detailed description thereof will be omitted. As is apparent from FIG. 7, the adjacent dynode arrays 16 are shifted from each other, and leaking electrons in the horizontal direction will not mix in the adjacent dynode array 16.

Embodiment 3

Figure 8:
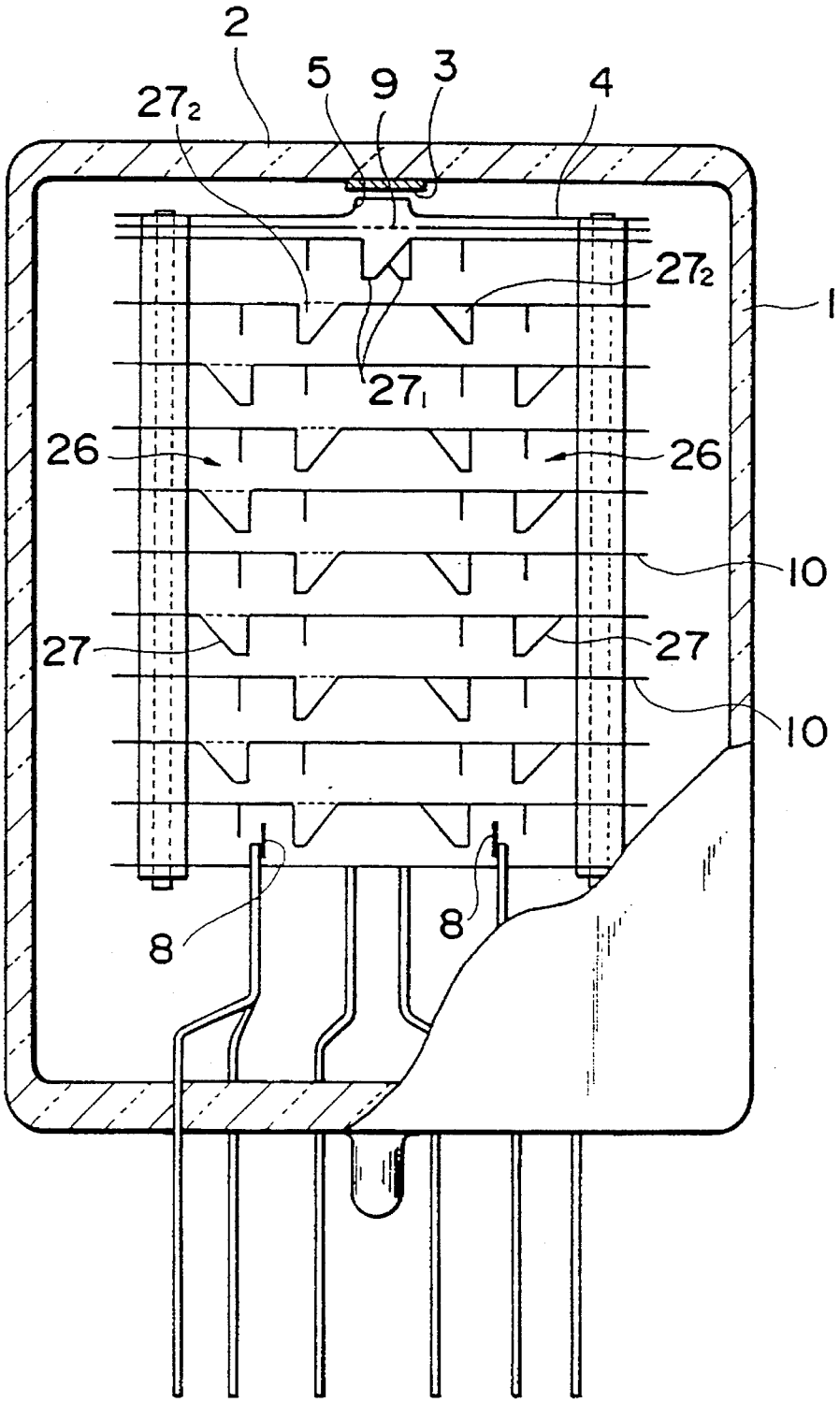
FIG. 8 is a longitudinal sectional view showing still another embodiment of a transmission type linear multi-anode photomultiplier according to the present invention.
Figure 9:
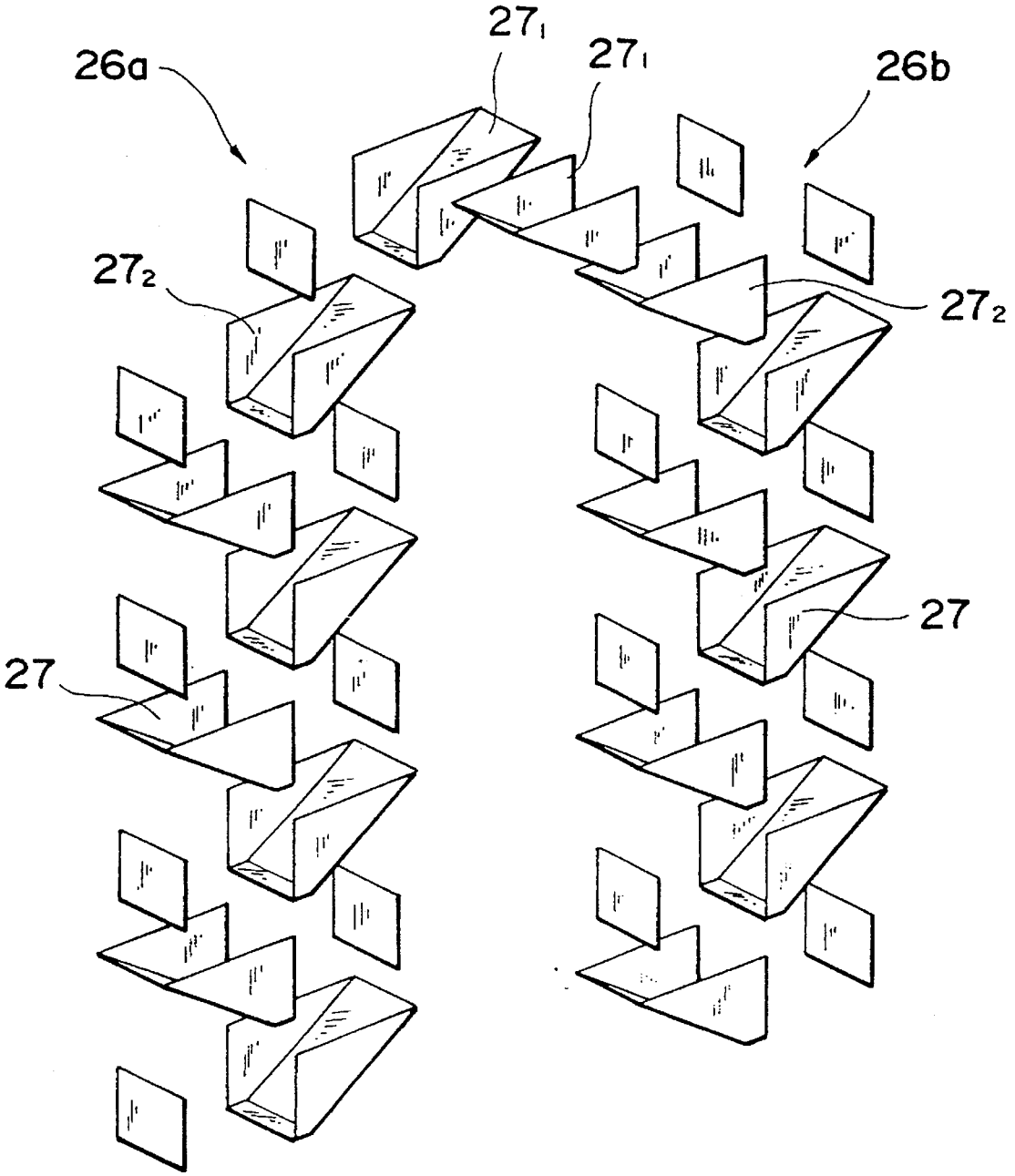
FIG. 9 is a perspective view showing the arrangement of dynode arrays used in the photomultiplier of FIG. 8.

FIG. 8 shows a photomultiplier according to the present invention in which dynode arrays 26 have venetian-blind structure in all the stages. In these dynode arrays 26, unlike in the embodiment described above, even the secondary electron emission direction of second-stage dynodes $\mathbf{27}_2$ is set the same as that of first-stage dynodes $\mathbf{27}_1$, as is clearly seen in FIG. 9. Accordingly, the distance between adjacent dynode arrays 26*a* and 26*b* is further increased, thereby further improving the effect of preventing mixing of leaking electrons.

All the above various embodiments are related to transmission type photomultipliers. However, the present invention can similarly be applied to a reflection type photomultiplier.

Embodiment 4

Figure 10:
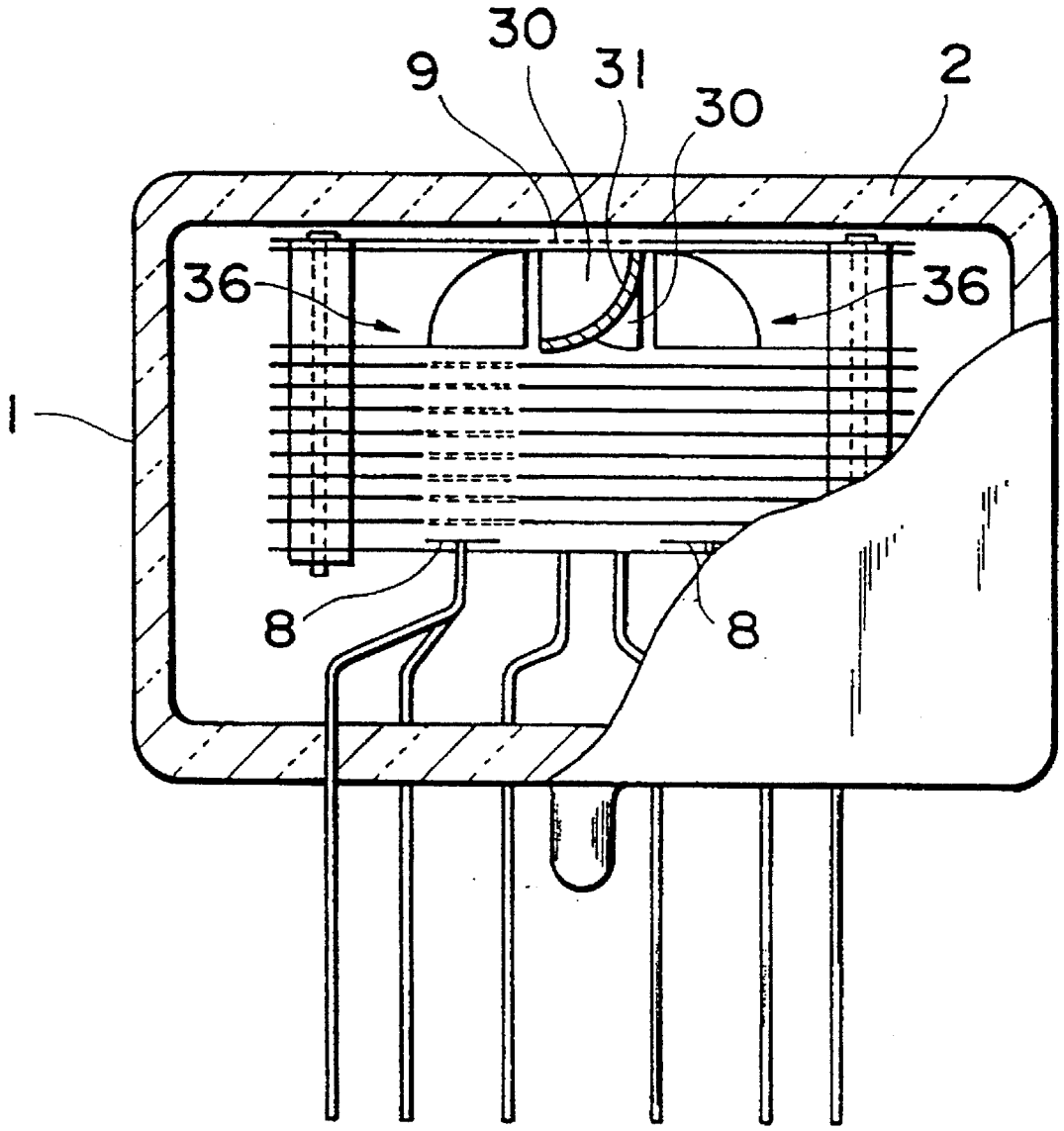
FIG. 10 is a longitudinal sectional view showing an embodiment of a reflection type linear multi-anode photomultiplier according to the present invention.

FIG. 10 shows a reflection type photomultiplier according to an embodiment of the present invention. Although the basic arrangement of this photomultiplier is close to that of the transmission type photomultiplier, this photomultiplier has neither photoelectric surfaces on the inner surface of incident window 2 of its glass bulb 1 nor a focusing electrode. Referring to FIG. 10, reference numerals 30 denote cylindrical quarter photocathodes. Reflection type photoelectric surfaces 31 are formed on the recessed surfaces of the photocathodes 30. Light beams to be measured incident through the incident window 2 passes through a mesh electrode 9 and are bombarded on the photoelectric surfaces 31 of the photocathodes 30 to generate photoelectrons. The photoelectrons are guided to dynode arrays 36 having a proximity mesh dynode structure, multiplied by the secondary electron emission effect, and captured by anodes 8.

Although the light beam incident ports of the photoelectric surfaces 31 are aligned one-dimensionally, the photoelectron emission directions of the adjacent light beam incident ports are set in opposite directions at 180° from each other. Accordingly, a dynode array 36 connected to a certain photocathode 30 is set in the opposite direction alternately from the adjacent dynode array 36, so that crosstalk between the dynode arrays 36 is prevented in the same manner as in the above transmission type photomultiplier.

Embodiment 5

Figure 11:
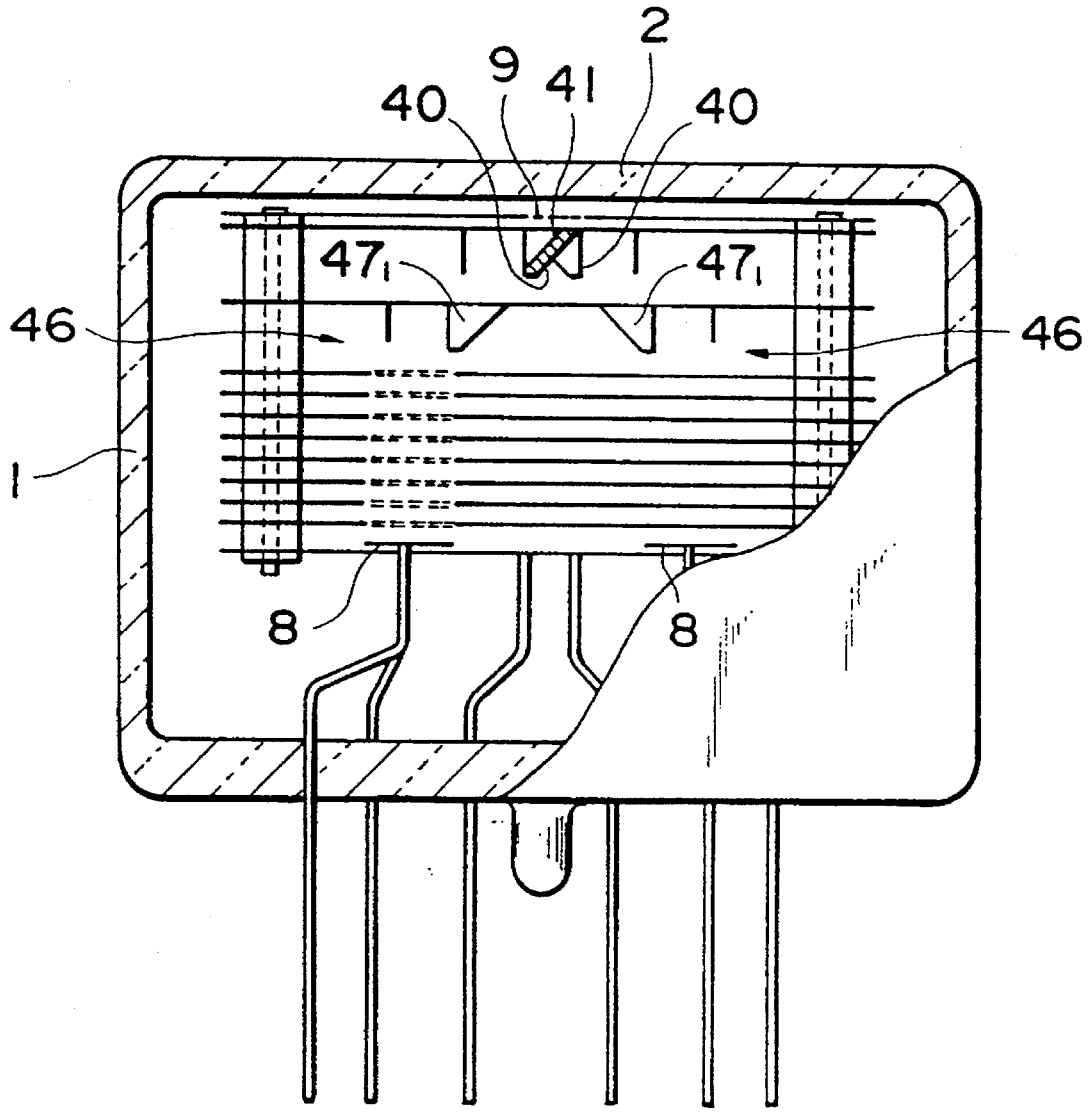
FIG. 11 is a longitudinal sectional view showing another embodiment of a reflection type linear multi-anode photomultiplier according to the present invention.

This reflection type photomultiplier has various types, and FIG. 11 shows an example. In a reflection type photomultiplier shown in FIG. 11, photocathodes 40 having reflection type photoelectric surfaces 41 and first-stage dynodes $\mathbf{47}_1$ of dynode arrays 46 have venetian-blind structure, and the dynodes from the second stage of the dynode arrays 46 have proximity mesh dynode structure. The photoelectron emission direction of the photoelectric surface 41 of one photocathode 40 is set in the opposite direction at 180° from that of the adjacent one, and the positions of the adjacent dynode arrays 46 are shifted from each other, which will be readily understood from FIG. 11.

Embodiment 6

Figure 12:
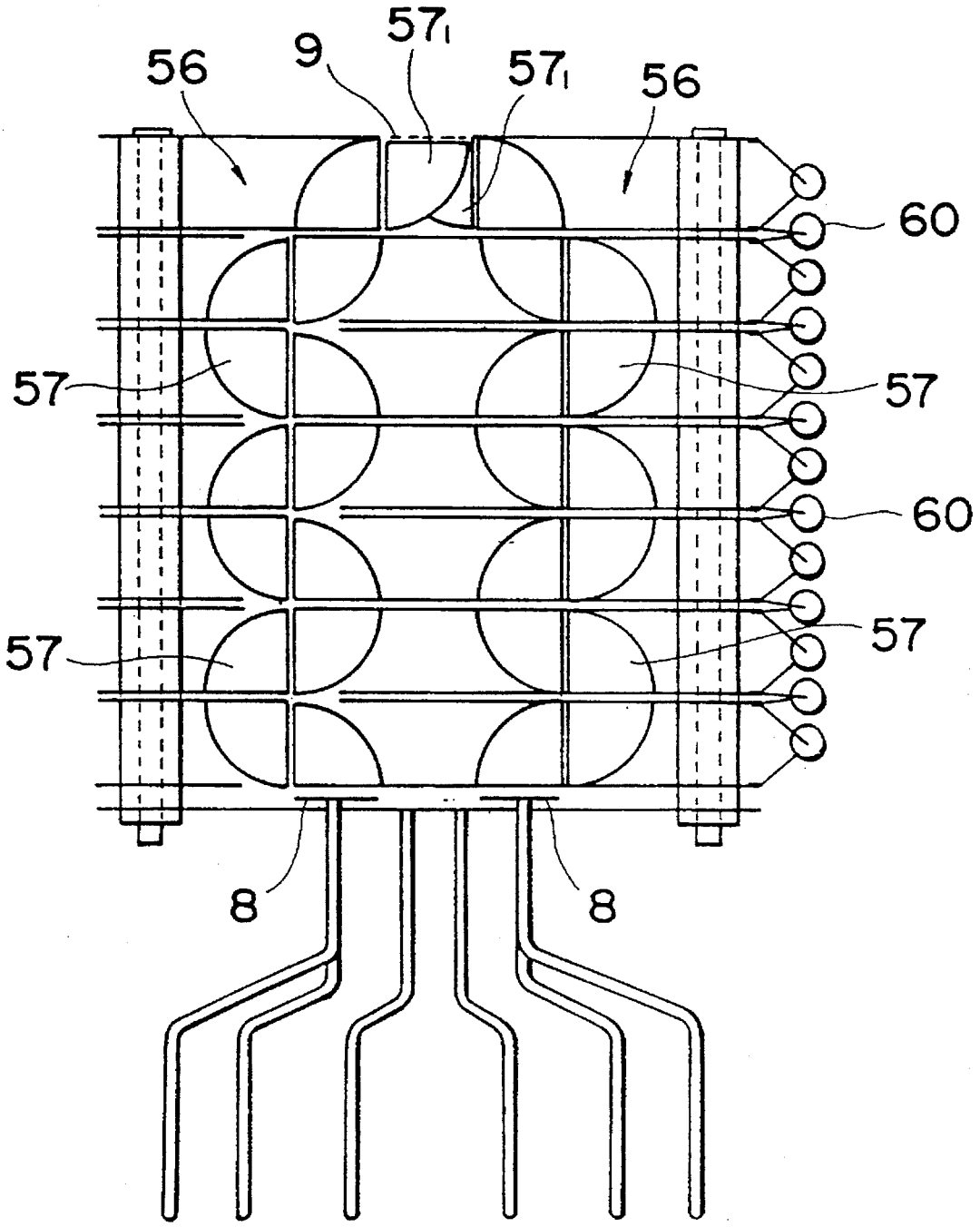
FIG. 12 is a longitudinal sectional view showing an embodiment of a linear multi-anode electron multiplier according to the present invention.

FIG. 12 shows a linear multi-anode electron multiplier for detecting the energy beams of electrons, ions and so forth. The electron multiplier corresponds to an arrangement obtained by removing a glass bulb, photoelectric surfaces, and a focusing electrode 4 from a transmission type photomultiplier. The electron multiplier of the embodiment shown in FIG. 12 has a plurality dynode arrays 56 having box-and-grid dynode structure, and the energy beam incident ports of first-stage dynodes $\mathbf{57}_1$ of the dynode arrays 56 are aligned one-dimensionally. The present invention is applicable to this electron photomultiplier as well. The direction of secondary electron emission of the first-stage dynode $\mathbf{57}_1$ of each dynode array 56 is set in the opposite direction at 180° from that of first-stage dynode $\mathbf{57}_1$ of an adjacent dynode array 56. Accordingly, when the energy beams of electrons are incident on the energy beam incident ports of the first-stage dynodes $\mathbf{57}_1$, the electrons leaking from the gaps among dynodes 57 will not mix in the adjacent dynode array 56 in completely the same manner as in the function at the diode arrays 6 of the above-mentioned photomultiplier. The electrons multiplied in the dynode arrays 56 are finally captured by anodes 8. In FIG. 12, reference numerals 60 denote bleeder resistors.

The dynodes of the first and second dynode arrays can also be arranged so that the dynodes of the first dynode array are shifted from corresponding dynodes of said second dynode array in a direction which is perpendicular to a direction along which said first and second transmission-type photoelectric surfaces are aligned.

More details of photomultiplier itself and the dynode structure used therefor are disclosed in Photomultiplier Handbook by RCA Corporation printed in USA.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. A photomultiplier comprising:

a transparent sealed container;

an incident window on which light to be measured is incident, said incident window being formed on one end face of said transparent sealed container;

first and second transmission-type photoelectric surfaces formed on an inner surface of said incident window and adjacently aligned;

first and second dynode arrays, both having a respective plurality of stages of dynodes, including respective first-stage and second-stage dynodes, for multiplying photoelectrons supplied from said first and second transmission-type photoelectric surfaces, respectively; and respective photoelectron incident ports of said first-stage dynodes of said first and second dynode arrays, said photoelectron incident ports opposing said first and second transmission-type photoelectric surfaces, respectively, wherein said first-stage dynodes are arranged in a substantially side-by-side manner, such that a direction of secondary electron emission of said first-stage dynode of said first dynode array is opposite to and away from a direction of secondary electron emission of said first-stage dynode of said second dynode array, and such that the directions of secondary electron emission of said first-stage dynodes of said first and second dynode arrays are substantially perpendicular to a direction along which said first and second transmission-type photoelectric surfaces are aligned.

2. A photomultiplier according to claim 1, wherein said dynodes of said first dynode array are arranged to be shifted from corresponding dynodes of said second dynode array in a direction perpendicular to a direction along which said first and second transmission-type photoelectric surfaces are aligned.

3. A photomultiplier according to claim 1, wherein said first and second dynode arrays are identical, and said first dynode array is rotated 180° relative to said second dynode array about an axis perpendicular to said first transmission-type photoelectric surface.

4. A photomultiplier according to claim 1, wherein said first and second dynode arrays have an in-line dynode structure.

5. A photomultiplier according to claim 1, wherein said first and second dynode arrays have a venetian-blind dynode structure.

6. A photomultiplier according to claim 5, wherein the direction of secondary electron emission of said first-stage dynode of said first dynode array is the same as the direction of secondary electron emission of said second-stage dynode of said first dynode array, and the direction of secondary electron emission of said first-stage dynode of said second dynode array is the same as the direction of secondary electron emission of said second-stage dynode of said second dynode array.

7. A photomultiplier according to claim 1, wherein said first and second dynode arrays have a proximity mesh dynode structure.

8. A photomultiplier according to claim 1, wherein said first and second dynode arrays have a box-and-grid dynode structure.

9. A photomultiplier comprising:

a transparent sealed container;

an incident window on which light to be measured is incident, said incident window being formed on one end face of said transparent sealed container;

first and second reflection-type photoelectric surfaces arranged in said sealed container and aligned adjacent to each other;

respective light beam incident ports of said first and second reflection-type photoelectric surfaces, said light beam incident ports being arranged to oppose said incident window; and first and second dynode arrays, both having a respective plurality of stages of dynodes, including respective first-stage and second-stage dynodes, for multiplying photoelectrons supplied from said first and second reflection-type photoelectric surfaces, respectively, said first and second dynode arrays being provided to correspond to said first and second reflection-type photoelectric surfaces, wherein said first-stage dynodes are arranged in a substantially side-by-side manner, such that a direction of photoelectron emission of said first-stage dynode of said first dynode array is opposite to and away from a direction of photoelectric emission of said first-stage dynode of said second dynode array, and such that the photoelectron emission of said first-stage dynodes of said first and second dynode arrays are substantially perpendicular to a direction along which said first and second reflective-type photoelectric surfaces are aligned.

10. A photomultiplier according to claim 9, wherein said dynodes of said first dynode array are arranged to be shifted from corresponding dynodes of said second dynode array in a direction perpendicular to a direction along which said first and second reflection-type photoelectric surfaces are aligned.

11. A photomultiplier according to claim 9, wherein said first and second dynode arrays are identical, and said first dynode array is rotated 180° relative to said second dynode array about an axis perpendicular to said first reflection-type photoelectric surface.

12. A photomultiplier according to claim 9, wherein said first and second dynode arrays have an in-line dynode structure.

13. A photomultiplier according to claim 9, wherein said first and second dynode arrays have a venetian-blind dynode structure.

14. A photomultiplier according to claim 13, wherein the direction of secondary electron emission of said first-stage dynode of said first dynode array is the same as the direction of secondary electron emission of said second-stage dynode of said first dynode array, and the direction of secondary electron emission of said first-stage dynode of said second dynode array is the same as the direction of secondary electron emission of said second-stage dynode of said second dynode array.

15. A photomultiplier according to claim 9, wherein said first and second dynode arrays have a proximity mesh dynode structure.

16. A photomultiplier according to claim 9, wherein said first and second dynode arrays have a box-and grid dynode structure.

17. An electron multiplier comprising:

first and second dynode arrays having a plurality of stages of dynodes, including respective first-stage and second-stage dynodes, for multiplying electrons generated when energy beams of electrons are incident thereon;

respective energy beam incident ports of said first-stage dynodes of said first and second dynode arrays, said energy beam incident ports being arranged in a direction along which said energy beams are incident, wherein said energy beam incident ports of said first and second dynode arrays are aligned adjacent to each other, such that a direction of secondary electron emission of said first-stage dynode of said first dynode array is opposite to and away from a direction of secondary electron emission of said first-stage dynode of said second dynode array, and such that the directions of secondary electron emission of said first-stage dynodes of said first and second dynode arrays are substantially perpendicular to a direction along which said energy beam incident ports of said first and second dynode arrays are aligned.

18. An electron multiplier according to claim 17, wherein said dynodes of said first dynode array are arranged to be shifted from corresponding dynodes of said second dynode array in a direction perpendicular to a direction along which said energy beam incident ports are aligned.

19. An electron multiplier according to claim 17, wherein said first and second dynode arrays are identical, and said first dynode array is rotated 180° relative to said second dynode array about an axis substantially coinciding with the direction along which said energy beams are incident.

20. An electron multiplier according to claim 17, wherein said first and second dynode arrays have a in-line dynode structure.

21. An electron multiplier according to claim 17, wherein said first and second dynode arrays have a venetian-blind dynode structure.

22. An electron multiplier according to claim 21, wherein the direction of secondary electron emission of said first-stage dynode of said first dynode array is the same as the direction of secondary electron emission of said second-stage dynode of said first dynode array, and the direction of secondary electron emission of said first-stage dynode of said second dynode array is the same as the direction of secondary electron emission of said second-stage dynode of said second dynode array.

23. An electron multiplier according to claim 17, wherein said first and second dynode arrays have a proximity mesh dynode structure.

24. An electron multiplier according to claim 17, wherein said first and second dynode arrays have a box-and-grid dynode structure.

* * * * *